United States Patent [19]

Cassai et al.

[11] 4,428,388

[45] Jan. 31, 1984

[54] ADJUSTABLE COSMETIC WAND

[76] Inventors: Gino H. Cassai, 924 E. 96th St., Brooklyn, N.Y. 11236; Henry J. Cassai, 95-15 107 St., Ozone Park, N.Y. 11416

[21] Appl. No.: 318,895

[22] Filed: Nov. 6, 1981

[51] Int. Cl.[3] ..... A45D 40/26

[52] U.S. Cl. ..... 132/88.7; 132/88.5; 401/122

[58] Field of Search ..... 132/88.7, 88.5; 401/122

[56] References Cited

U.S. PATENT DOCUMENTS

| | | | |
|---|---|---|---|
| 1,588,266 | 6/1926 | Rempe | 401/122 |
| 3,415,604 | 12/1968 | Ahrens et al. | 401/122 |
| 3,471,244 | 10/1969 | Melocchi | 401/122 |
| 4,165,755 | 8/1979 | Cassai | 132/88.7 |

*Primary Examiner*—Gregory E. McNeill

[57] ABSTRACT

An adjustable cosmetic wand for use with a cosmetic container comprises a container top having a hollow shaft attached therein and centrally thereof. A rod is positioned for reciprocation within the hollow shaft and has a flexible spring filament attached thereto. The opposite end of the flexible filament has means for permitting attachment of various cosmetic applicators. The flexible filament is extendable out of and retractable into the hollow shaft and container top by means of a push button which is attached to the reciprocable rod. The flexible filament is a pre-bent device which will assume various angles with respect to the perpendicular as the device emerges from the shaft and container top. An extension shaft may be attached to the outer end of the hollow shaft by a pivot and the reciprocable rod may be toothed or geared on one end and adapted to mesh with a toothed element or a gear on the extension shaft. A push button or a rotatable knob may be employed to reciprocate or rotate the rod whereby the toothed elements will mesh causing the extension shaft to move in an arc, the angle of which may be determined by the amount of advancement of the button or rotation of the knob. Indicia is employed on the container top whereby the user may predetermine the angle of bend of the applicator by moving the button or rotating the knob a certain distance.

10 Claims, 13 Drawing Figures

ADJUSTABLE COSMETIC WAND

BACKGROUND OF THE INVENTION

1. Field of the Invention

This invention pertains to an adjustable cosmetic applicator of the type for applying mascara, eye shadow, lip-gloss, nail polish and eye liner.

2. Statement of the Prior Art

The prior art discloses adjustable brushes having bristles for applying mascara and the like. The closest prior art known to the inventors are those listed below. None show a cosmetic container cap having a hollow shaft and extensible means whereby the cosmetic applicator may be adjusted to various angles.

| Patentee | U.S. Pat. No. | Issue Date |
|---|---|---|
| T. G. Wonderly | 430,909 | June 24, 1980 |
| J. Klugmann | 2,750,616 | May 19, 1956 |
| E. V. Aylott | 3,703,180 | Nov. 21, 1972 |
| Kingsford | 3,998,235 | Dec. 21, 1976 |
| Cassai | 4,165,755 | Aug. 28, 1979 |

SUMMARY OF THE INVENTION

A wand applicator comprises a container cap for grasping by the hand, an extensible member and bristles at the end thereof for applying mascara and the like to the eyelash of the user. Herebefore, mascara and the like was applied by bristles of a wand, the shaft of which was adjustable in an arc as it was withdrawn from the container. It was necessary to employ indicia on the container cap so as to indicate in which direction to apply pressure on the shaft to bend same otherwise pressure applied on the shaft in the wrong direction could possibly result in breakage of the shaft.

Accordingly, it is one object of this invention to provide a cosmetic wand applicator which is automatically adjustable to provide various angles or positions of the applicator brush without the need of the cosmetic container.

It is another object of this invention to provide a cosmetic wand applicator attached to a cosmetic container cap having means for adjusting the angle or position of the applicator brush without the need for the cosmetic container.

It is still a further object of this invention to provide a cosmetic wand applicator with means whereby the user may adjust the angle of the applicator brush by moving a button on the container cap to which the wand is attached.

Another object of this invention is to provide a cosmetic wand applicator with means whereby the user may adjust the angle of the applicator brush by turning a knob on the container to which the wand is attached.

Another object of this invention is to provide a cosmetic wand applicator having a flexible filament which may be lengthened or shortened by means incorporated in the container cap to which the wand is attached.

Other and further objects of this invention will become apparent to those skilled in the art from a consideration of the following specification when read in conjunction with the annexed drawings.

DESCRIPTION OF THE PREFERRED EMBODIMENT

Figure 1:
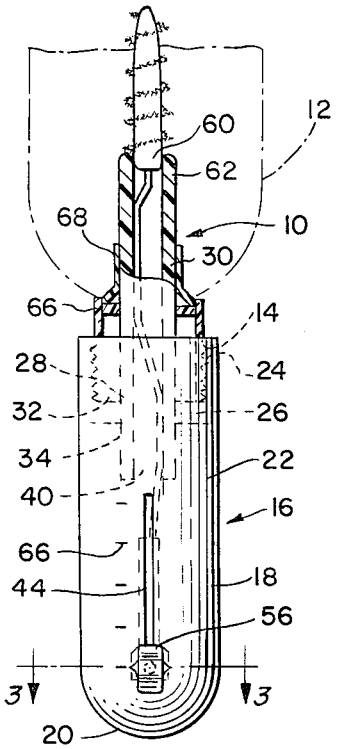
FIG. 1 is a side elevational view of a mascara wand attached to a cosmetic container cap which is fastened to a cosmetic container. The wand and cap are partially broken away to show details.

Referring to the drawing in more detail, FIGS. 1–3 and 11–13 show a first form of the mascara applicator wand 10. The wand 10 is employed with a cosmetic container 12 having an externally threaded neck 14.

The wand 10 comprises a container top 16 having an outer hollow shell 18 and a rounded end wall 20 and an inner wall 22 which is threaded at 24 for engagement with the threads 14 on the neck of the container whereby the top 16 functions to close the container 12 when the wand 10 is not in use. An inner disc 26 having a central opening 28 is secured to the inner wall 22 beyond the threads 24. The disc 26 serves as a support for the wand shaft 30 and as a stopper for the end 32 of the container 12. One end 34 of the wand shaft 30 extends through the central opening 28 of the disc 26. The shaft 30 is secured to the disc by any suitable means. The end 34 of the shaft 30 may extend into the cap 16 any suitable length and the opposite end 36 extends a length beyond the cap opening 38. The shaft 30 is hollow and may have a slot 40 cut therein adjacent the end 42 extending to a point adjacent the disc 26. A similar slot 44 is cut in the outer shell 18 and is coincident with the inner slot 40 on the end of shaft 30. The function of these slots will be described below.

A rod 46 having an enlarged end 48 is reciprocal within the hollow shaft 30. The enlarged end 48 is larger than the diameter of shaft 30 and serves, in certain modifications, as a stop for the rod 46. A pre-bent flexible spring filament in the nature of a steel wire 50 or the like is attached at one end to the rod 46 and has means at the opposite end thereof for facilitating connection to diverse cosmetic applicators 52 having bristles 54 thereon. A button 56 is connected to the enlarged end 48 of rod 46 by means of a connecting pin 58. The connecting pin 58 extends through the slots 40 and 44 as described so as to be movable therealong. The button 56 is exterior of the casing 18 and is slidable therealong by its connection to pin 58 which slides in slots 40 and 44. By means of this construction, the flexible pre-bent filament or steel wire 50 is extensible and retractable in the cap 16 and hollow shaft 30. For example, when the button 56 is in the position shown in FIG. 1, the steel wire 50 is retracted into the shaft 30 and the interior of the cap 16. The end 60 of the mascara applicator 52 extends a distance into the end 62 of the shaft 30 whereby the applicator may be used in a conventional manner. Thus, when the button 56 is fully retracted, the rod 46 is similarly retracted in the shaft 30 and the pre-bent steel wire 50 is completely retracted into the shaft 30 and cap 16.

Figure 2:
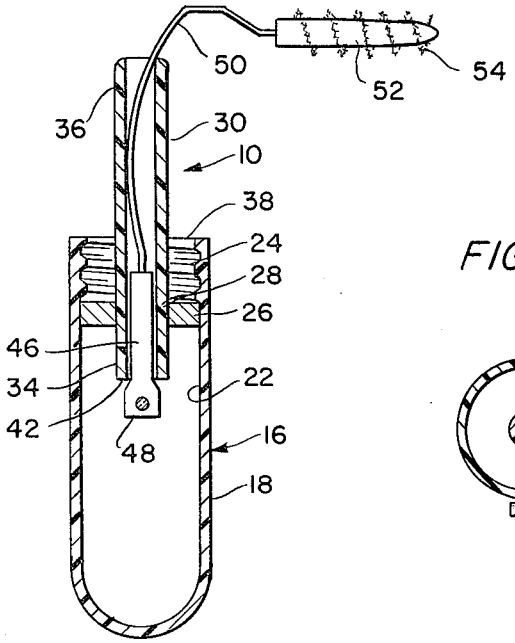
FIG. 2 is a side elevational view of a mascara wand having an extensible flexible filament attached to a cosmetic container cap.
Figure 3:
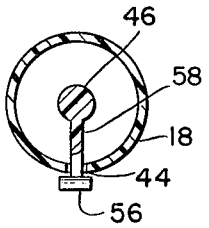
FIG. 3 is an end view of the container cap taken along the line 3—3 of FIG. 1 and shows the mechanism by which the flexible filament is extended outwardly.

Since the steel wire 50 is pre-bent in the shape shown in FIG. 2, progressive extension thereof by means of forwardly pressing on button 56 will cause the end of the wire, as it extends from the shaft 30, to assume various angles depending on the length of the extension. For example, moving button 56 small increments forwardly will result in the end of the steel wire 50 and attached applicator assuming small different angles from that shown in FIG. 1 to that shown in FIG. 2 and FIG. 11. The outside of the shell 18 is calibrated at 66 so that the user may determine in advance the angle of bend of the wire and the applicator as the button is moved along the indicia.

By this construction, the applicator automatically assumes various angles as the steel wire is extended out of the shaft 30 and cap 16 by sliding the button forwardly. This may be accomplished by the user using one hand to adjust the slidable button whereby the mascara applicator tip angle may be varied automatically at the discretion of the user.

The versatility of this applicator will be evident by the use of a very thin pre-bent flexible filament or steel wire or the like which permits the user to work close to the inner and outer eyelashes. Extension of the steel wire will result in automatic changes in the angle of the applicator brush thus permitting the user to apply cosmetics with ease and without concern for possible breakage of the wand shaft as with the prior art.

When not in use, the applicator is stored in the container 12 which may contain any of a variety of cosmetics. When the applicator is withdrawn for use, the applicator brush bristles 54 is drawn against a wiper 66 in the neck of the bottle and functions to remove excess cosmetics or the like from the bristles of the applicator. An automatic sealable diaphram 68 is also positioned within the neck of the bottle 12 and serves to prevent cosmetic material from spilling when the applicator is in use.

Figure 7:
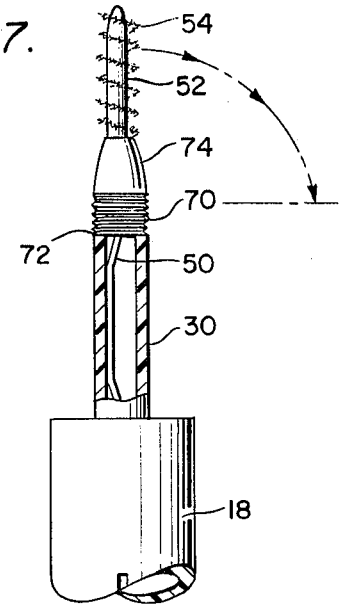
FIG. 7 is a side elevational view of the wand having a cylindrical steel spring member enclosing the flexible spring filament.
Figure 8:
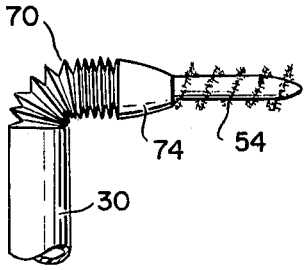
FIG. 8 shows the wand of FIG. 7 bent 90°.
Figure 9:
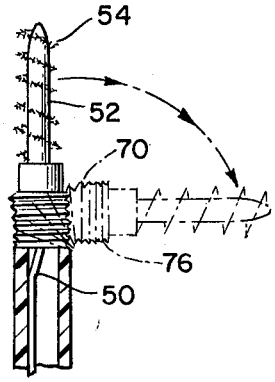
FIG. 9 is a wand similar to FIG. 8 except that the flexible spring filament is connected directly to the upper portion of the cylindrical steel spring with an applicator brush being attached to cylindrical steel spring.
Figure 12:
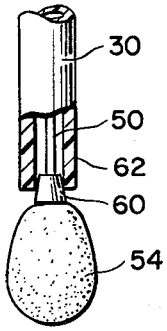
FIG. 12 shows an applicator tip attached to the inner extensible flexible spring filament.
Figure 13:
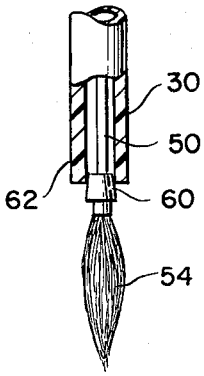
FIG. 13 shows another type of applicator.

FIGS. 12 and 13 show use of the applicator brushes of different types which are easily attached to the end of the wire 50. The brushes may be press fitted or screwed onto the end of the wire in any suitable manner. FIGS. 7–8 show a cylindrical spring 70 attached at one end to the edge 72 of the shaft 30 and at the other end to a stub extension shaft 74 which carries the various cosmetic applicator brushes. The end of the wire 50 is attached to the stub shaft and extension of the wire by forward movement of the button 56 will cause the cylindrical spring 70 to move in accordance with the bend of the wire 50. The pre-bent steel wire is thus encased and protected from moisture and dirt. FIG. 9 shows a modification of the invention as seen in FIGS. 7 and 8. In this modification, the upper wand extension shaft 74 is eliminated and the end of the spring wire 50 is connected directly to the upper end 76 of the cylindrical spring 70. Applicator tips of various types may be attached to the end 76 of the cylindrical steel member 70 by any suitable means. Again, the steel wire 50 is encased whereby moisture and dirt are prevented from contacting same.

Figure 4:
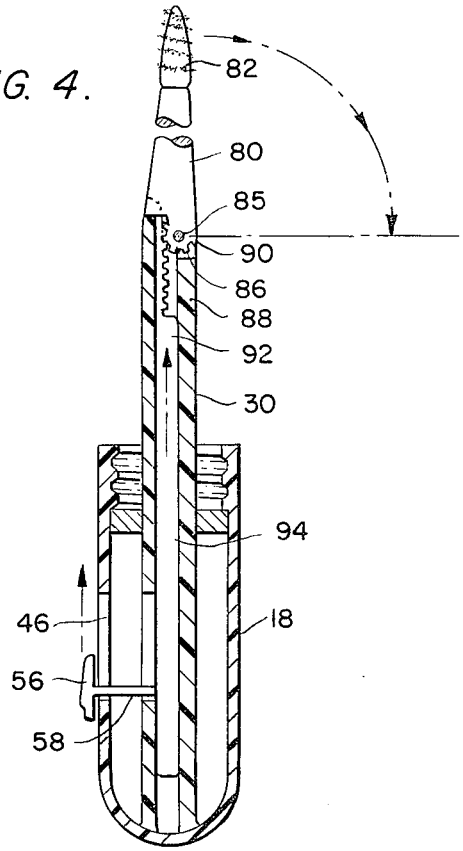
FIG. 4 is a side elevational view of a mascara wand having a hollow shaft to which there is attached a pivotable extension shaft having a toothed gear thereon and a push-rod having teeth which meshes with the toothed gear.
Figure 5:
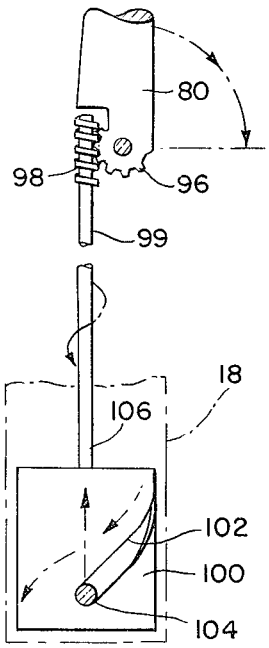
FIG. 5 is a view similar to FIG. 4 except that the adjusting rod is rotatable by a rotatable knob inside the cap whereby the rod and the gear on the end thereof meshes with a gear on the extension shaft.
Figure 6:
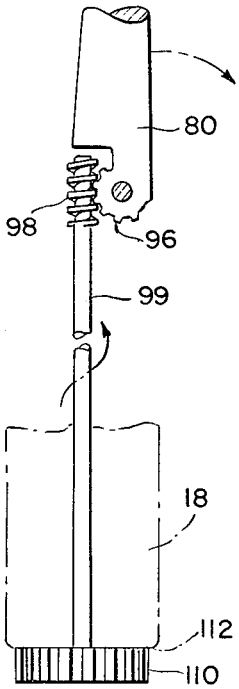
FIG. 6 is a view similar to FIG. 5 except that the method of rotating the rod is a knob outside the container cap.

FIGS. 4–6 show further modifications of the wand applicator. An extension shaft 80 having means for attaching various applicator brushes 82 thereto is pivotably attached by pin 85 to pivot block 86 which forms a part of the end 88 of the shaft 30. The extension shaft 80 has a toothed end 90 which meshes with a toothed end 92 of a push-rod 94 which reciprocates within the hollow shaft 30 by means of the button 56 through the connecting pin 58 which extends through the slots 40 and 44. Thus, forward movement of the button 56 causes the push rod 94 to advance whereby the extension shaft 80 moves in an arc as shown by the arrows in FIG. 4. Calibration indicia, as shown in FIG. 1, is employed to permit predetermination of the angle of bend of the shaft 80 and its associated brush 82.

FIGS. 5 and 6 show the extension shaft 80 with toothed gear 96 meshed with a worm geam 98 on the end of a rotatable rod 99. Journaled within the hollow casing 18 is a rotatable knob 100 having a spiral slot 102 therein. A pin 104 is attached to the inner end 106 of the rod 99 at one end thereof and extends through the slot 102 at the opposite end. Rotation of the knob 100 causes the pin 104 to travel in the spiral slot 102 thus advancing and turning the rod 99 whereby the worm gear 98 turns the gear 96 causing the extension shaft to move in an arc as shown in FIG. 5. As previously described for the push button, the knob 100 may be calibrated whereby the user may determine in advance the desired angle of the applicator brush on the shaft 80. FIG. 6 shows a knob 110 exterior of the cap and attached to the rod 99 which extends through casing 18. Sufficient clearance between the knob 110 and the end 112 of the casing 18 is provided to permit linear movement of the rod 99 whereby the worm gear 98 will mesh with the gear 96 of the applicator shaft 80 thus casing the applicator to move in an arc as shown in FIG. 6.

Figure 10:
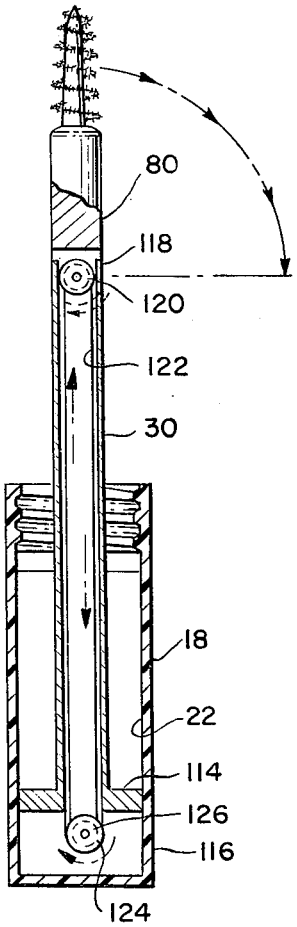
FIG. 10 is a side elevational view of the wand applicator showing the extension shaft pivotable by means of a pulley which is operated by a knob extending out of the cosmetic container.
Figure 11:
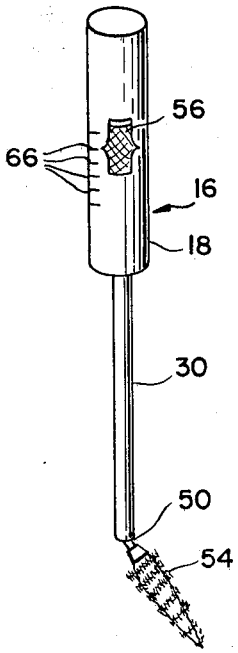
FIG. 11 is a view of the wand, extension shaft and the slidable button by which the inner flexible spring filament is extended out of and retracted into the shaft.

A further modification of this invention is shown in FIG. 10. As previously described, the casing 18 is hollow and has a hollow shaft 30 attached interiorly therein by means of a disc 114 which is secured to the inside wall 22 adjacent the end 116 of the casing 18. The applicator extension shaft 80 is journaled on the end 118 of the shaft 30 by a suitable bearing 120. The bearing 120 may be in the form of a sheave about which there is trained a pulley 122. The opposite end of the pulley is trained about a sheave 124 which is suitable journaled within the casing 18 near the end 116. The sheave 124 is rotatable by a suitable button which extends through the casing 18 and is connected to the sheave by a suitable pin 126. By this construction, rotation of the button (not shown) causes rotation of the sheave 124 which causes the pulley 122 to rotate the extension tip 80 by means of its engagement with the sheave 120. The operating button (not shown) may be calibrated to permit the user to determine in advance the angle of the applicator brush.

While the invention has been described in detail with respect to the preferred embodiment and modifications thereof, many other possible embodiments of this invention may be made without departing from the scope thereof. It is to be understood that all matter herein set forth or shown in the accompanied drawings is to be interpreted as illustrative and not in a limited sense.

What is claimed is:

1. An adjustable cosmetic wand for use with a cosmetic container, the cosmetic wand comprising:
   a container top having an outer shell;
   a hollow shaft attached to the outer shell and extending interiorly and exteriorly thereof;
   a rod reciprocal within the hollow shaft;
   a flexible spring filament attached at one end to the reciprocal rod;
   a cosmetic applicator brush attached to the opposite end of said flexible spring filament; and
   means on said container top for reciprocating said rod within the shaft whereby the flexible spring filament and applicator brush are extended out of and retracted into the shaft and container top.

2. An adjustable cosmetic wand as defined in claim 1, wherein:
   said container has a threaded throat and wiper means therein for said cosmetic applicator brush, and said container top has a threaded end whereby the wand may be attached to the container by threading the top onto the container neck.

3. An adjustable cosmetic wand as defined in claim 1, wherein:
   said flexible filament is a pre-bent steel wire.

4. An adjustable cosmetic wand as defined in claim 1, wherein:
   said means for reciprocating said rod comprises a slidable button attached by a pin to said rod through a slot in said container top outer shell.

5. An adjustable cosmetic wand as defined in claim 3, wherein:
   said pre-bent steel wire with applicator brush attached thereto automatically assumes different angles as the wire is extended out of the container top outer shell and hollow shaft.

6. An adjustable cosmetic wand as defined in claim 1, wherein:
   the opposite end of said flexible spring filament is encased within a cylindrical steel spring.

7. An adjustable cosmetic wand as for use with a cosmetic container having a threaded throat, the cosmetic wand comprising:
   a container top having a hollow shell and a threaded interior end;
   a hollow shaft secured within said hollow shell centrally thereof;
   an extension shaft pivotably attached to an outer end of said hollow shaft, said extension shaft having toothed means thereon;
   a rod reciprocable within said hollow shaft and having toothed means at one end thereof for meshing with said toothed means of said extension shaft; and
   means for reciprocating said rod whereby said extension shaft is pivoted in an arc by interaction of said toothed means.

8. An adjustable cosmetic wand for use with a cosmetic container having a threaded throat, the cosmetic wand comprising:
   a container top having a hollow shell and a threaded end;
   a hollow shaft attached interiorly of said hollow shell centrally thereof and having an exterior portion;
   a rotatable rod extending through said hollow shaft having a worm gear at one end thereof exterior of said exterior portion of said shaft;
   means rotatable within said outer shell and connected to said rod for rotation thereof;
   a brush tipped extension shaft having toothed means thereon journaled for pivotal movement on the exterior portion of said hollow shaft; and
   said worm gear meshing with said toothed means upon rotation of said knob whereby said extension shaft pivots in an arc.

9. An adjustable cosmetic wand as defined in claim 8, wherein:
   said means is exterior of said outer shell and connected to said rod for rotating said rod and said gear end thereof gear whereby the brush tipped extension shaft pivots in an arc.

10. An adjustable cosmetic wand for use with a cosmetic cotainer having a threaded throat, the cosmetic wand comprising:
   a container top having a hollow shell and a threaded interior end;
   a hollow shaft attached interiorly of said top and having an exterior portion of;
   a brush tipped extension shaft pivotally attached to said exterior portion and having a pulley sheave thereon;
   a rotatable knob on said container top, said rotatable knob attached to a pulley sheave journaled interiorly of said container top; and
   pully means extending between said pully sheaves whereby rotation of said knob rotates said pulley means causing the brush tipped extension shaft to pivot in an arc.

* * * * *